United States Patent [19]

Kataoka et al.

[11] 4,168,172

[45] Sep. 18, 1979

[54] METHOD FOR SUBBING POLYESTER FILMS

[75] Inventors: Shinji Kataoka; Yukio Shinagawa; Hidefumi Sera; Jun Yamaguchi, all of Minami-ashigara, Japan

[73] Assignee: Fuji Photo Film Co., Ltd., Minami-ashigara, Japan

[21] Appl. No.: 962,733

[22] Filed: Nov. 21, 1978

[30] Foreign Application Priority Data

Nov. 24, 1977 [JP] Japan ..... 52-141030

[51] Int. Cl.[2] ..... G03C 1/80; B05D 3/02

[52] U.S. Cl. ..... 96/87 R; 96/67; 96/87 A; 96/111; 96/114.8; 96/115 R; 260/607 AR; 260/607 AL; 427/207 D; 427/385 B; 427/407 G; 427/414; 428/913

[58] Field of Search ..... 96/67, 87 R, 115 P, 96/115 R, 111, 114.8; 427/385 B, 407 G, 414, 207 D; 428/483, 411, 913; 260/607 A, 607 AL, 607 AR

[56] References Cited

U.S. PATENT DOCUMENTS

| | | | |
|---|---|---|---|
| 3,582,339 | 6/1971 | Martens et al. | 96/87 R |
| 3,833,403 | 9/1974 | Kogure et al. | 96/87 R |
| 3,841,872 | 10/1974 | Burness et al. | 96/67 |
| 3,868,257 | 2/1975 | Horii et al. | 96/111 |
| 3,874,877 | 4/1975 | Omichi et al. | 96/87 R |
| 3,957,882 | 5/1976 | Silverman et al. | 260/607 AL |
| 4,019,908 | 4/1977 | Wright | 96/114 |
| 4,108,848 | 8/1978 | Habu et al. | 96/111 X |

*Primary Examiner*—Morris Kaplan
*Assistant Examiner*—Thurman K. Page
*Attorney, Agent, or Firm*—Sughrue, Rothwell, Mion, Zinn and Macpeak

[57] ABSTRACT

A polyester film, typically a support for photographic material is coated, prior to coating a hydrophilic organic colloid layer, with a subbing composition containing at least one compound represented by the general formula

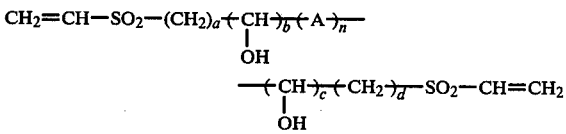

wherein a and d each represent 1 or 2; b and c each represent 0, 1, or 2 but b and c must not be 0 at the same time, A represents a divalent group; and n represents 0 or 1.

7 Claims, No Drawings

METHOD FOR SUBBING POLYESTER FILMS

BACKGROUND OF THE INVENTION

1. Field of the Invention

The present invention relates to a method for subbing polyester films and, more particulary, the invention relates to a method for subbing polyethylene terephthalate films (hereinafter, referred to as PET films) as supports for photographic materials.

2. Description of the Prior Art

Polyester films, in particular, PET films possess various features such as high mechanical strength, excellent dimensional stability, etc., as compared with other plastic films and hence the fields of applications of these films have greatly increased. Particularly, the demand for these films as supports for photographic materials has grown rapidly.

However, because polyester films are generally highly crystalline, are chemically inactive, have high chemical resistance, and are very hydrophobic, it is difficult to strongly adhere a hydrophilic organic colloid layer, such as a photographic silver halide emulsion layer, to the polyester film. In general there are various methods of strongly adhering a hydrophilic organic colloid layer to a polyester film. For example, the surface of a polyester film may be subjected to a surface activation treatment such as ultraviolet irradiation and then coated with a solution of hydrophilic resin using a solvent for the polyester or using a mixed organic solvent containing a swelling agent or the polyester surface may be coated with a liquid subbing composition comprising a gelatin dispersion. In another method a vinylic copolymer layer comprising vinylidene chloride, vinyl chloride, styrene, an acrylic acid ester, acrylic acid, etc., is formed on the surface of a polyester film and then a subbing composition comprising an aqueous gelatin solution or an aqueous gelatin dispersion is coated thereon.

On the other hand, the adhesive strength of a hydrophilic organic colloid layer after forming a subbing layer on a polyester film and then forming thereon the hydrophilic organic colloid layer is generally evaluated on two basis. One is the adhesive strength (hereinafter, referred to as the adhesive strength in wet state) when the photographic film thus obtained is placed in an aqueous solution such as, for example, a photographic developer, etc. The other is the adhesive strength (hereinafter, referred to as the adhesive property in dry state) in the dry state of the photographic film thus obtained. However, generally if the adhesive property of a hydrophilic organic colloid layer to the polyester film is insufficient in the dry state, it is sufficient in wet state and, in contrast with this, if the adhesive property is insufficient in wet state, it is sufficient in dry state.

Therefore, it is quite difficult to satisfy the both cases and as a manner for overcoming the difficulty, a method wherein a hardening agent is incorporated in the subbing gelatin layer has been adopted.

Hitherto, as the hardening agent for the subbing layer, formalin, chromium complex salts, ethyleneimine compounds, etc., have been mainly used. It is desired that the hardening agent used for this purpose is highly soluble in an aqueous solution or an organic solvent, does not react with gelatin in solution but reacts immediately after coating without having any chemical influence on the photosensitive property of the photographic silver halide emulsions, and further has no toxicity to human body.

If the reactivity of a hardening agent is too high, the reaction thereof in solution proceeds fast and causes deterioration of the coating composition with the passage of time, while if the reactivity is too slow, a heat treatment at a comparatively high temperature is required after coating, which sometimes results in reducing the flatness of the support.

SUMMARY OF THE INVENTION

Therefore, an object of this invention is to provide a method for subbing a polyester film which can adhere thereto strongly a hydrophilic organic colloid layer in the wet state and also in the dry state.

A second object of this invention is to provide a subbing method which does not spoil the flatness of the polyester film.

Another object of this invention is to provide a method for subbing a polyester film using a subbing composition which can be stored stably for a long period of time.

Still another object of this invention is to provide a photographic material having a subbing layer which adheres strongly a photographic silver halide emulsion layer to a polyester film, in particular PET film.

These and other objects of this invention will become apparent by the following description of the invention.

The objects of this invention as described above can be attained by forming on a polyester film, prior to forming a hydrophilic organic colloid layer such as a photographic silver halide emulsion layer, a subbing layer containing at least one compound represented by following general formula I

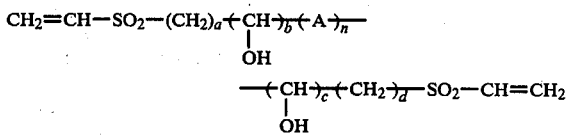

wherein a and d each represent 1 or 2; b and c each represent 0, 1, or 2 but b and c must not be 0 at the same time; A represents a divalent group; and n represents 0 or 1.

DETAILED DESCRIPTION OF THE INVENTION

In the above general formula (I), the divalent group represented by A includes any divalent group, but preferably a cyclic hydrocarbon group such as an arylene group having 6 to 12 carbon atoms, e.g., a phenylene group, etc., an acyclic hydrocarbon group such as an alkylene group having 1 to 8 carbon atoms, e.g., a methylene group, an ethylene group, a trimethylene group, a tetramethylene group, etc. The divalent group represented by A can also be an aralkylene group having a total of 8 to 10 carbon atoms. One to three of the carbon atoms of the group defined above for A can be replaced by a hetero atom such as a nitrogen atom, a sulfur atom, an oxygen atom, etc. Suitable examples of groups containing hetero atom(s) include a group containing a $-CH_2OCH_2-$ group, a $-(CH_2CH_2O)_2-CH_2CH_2-$ group, a $-CH_2CH_2OCH_2CH_2-$ group, a

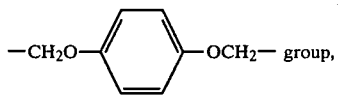

etc. More preferably A is a divalent branched of straight chain alkylene group having 1 to 4 carbon atoms. Also, the chain can be substituted, for example, with one or more of an alkoxy group having 1 to 4 carbon atoms such as a methoxy group, an ethoxy group, etc., a halogen atom such as a chlorine atom, a bromine atom, etc., a hydroxy group, an acetoxy group and the like.

According to this invention, it has been discovered that by forming the subbing layer containing at least one of the compounds shown by above-indicated general formula (I) on a polyester layer, a hydrophilic organic colloid layer can be adhered strongly to a polyester film in not only the dry state but also in the wet state. It is most preferred that in general formula (I), a, b, c, d, A and n meet the following relationship $$\frac{\text{molecular weight}}{\text{number of hydroxyl groups in one molecule}} \leqq 260.$$

That is, it is preferred that the value of the molecular weight of the compound divided by the number of the hydroxyl groups contained in one molecule thereof be less than about 260.

The compounds satisfying the above relation are very preferred since they can be easily dissolved in water and hence water can be used as the solvent for the subbing composition.

The compounds shown by general formula (I) are novel compounds but are prepared with a good yield by known general reactions. That is, the vinylsulfonyl compound of formula (I) is prepared by a general method of forming vinyl group, e.g., by dehydrochlorinating a haloethylsulfonyl compound (i.e., the compound of formula (I) but for the presence of a haloethylsulfonyl group instead of a vinyl sulfonyl group) such as a chloroethylsulfonyl compound, etc., using a base such as triethylamine, trimethylamine, triethylenediamine, 1,8-diazobicyclo[5,4,0]-7-undecene, etc., in a solvent such as acetone, acetonitrile, chloroform, benzene, etc., at −60° to 80° C. at atmospheric pressure for about 10 minutes to several days, or by dehydrating a hydroxyethylsulfonyl compound. Further, the chloroethylsulfonyl compound (that starting material) can be prepared, for example, by oxidizing the corresponding hydroxyethylsulfide using an oxidizing agent such as hydrogen peroxide, peracetic acid, etc., in a solvent such as water, acetic acid, ethyl acetate, acetone, methanol, etc., in the presence of a catalyst such as tungstic acid, phosphoric acid, acetic acid, etc., at 0° to 120° C. and at atmospheric pressure for about 10 minutes to several days to form the corresponding hydroxyethylsulfone and chlorinating this hydroxyethylsulfone using a chlorinating agent such as thionyl chloride, phosphorus pentachloride, phosphorus trichloride, etc., in the absence of a solvent or in the presence of a solvent such as chloroform, toluene, etc., in the presence of a catalyst such as pyridine, dimethylformamide, etc., at about −20° to about 200° C. and at atmospheric pressure for about 10 minutes to several days, or by chlorinating a hydroxyethylsulfide and then oxidizing the product obtained. Furthermore, the hydroxyethylsulfide can be easily prepared by reacting a compound having an epoxy group or a precursor thereof, i.e., a halo compound having a hydroxy group with mercaptoethanol in a solvent such as water, methanol, ethanol, dimethylformamide, etc., in the presence of a catalyst such as potassium hydroxide, sodium hydroxide, triethylamine, etc., at about −40° to about 120° C. and at atmospheric pressure for about 10 minutes to several days.

Typical examples of the compounds shown by general formula (I) are illustrated below although this invention are not limited to the use of these compounds.

Compound (1):

$$CH_2{=}CHSO_2CH_2\underset{\underset{OH}{|}}{C}HCH_2SO_2CH{=}CH_2$$

Compound (2):

$$CH_2{=}CHSO_2CH_2\underset{\underset{OH}{|}}{C}H\underset{\underset{OH}{|}}{C}HCH_2SO_2CH{=}CH_2$$

Compound (3):

$$CH_2{=}CHSO_2CH_2\underset{\underset{OH}{|}}{C}HCH_2\underset{\underset{OH}{|}}{C}HCH_2SO_2CH{=}CH_2$$

Compound (4):

$$CH_2{=}CHSO_2CH_2\underset{\underset{OH}{|}}{C}HCH_2CH_2SO_2CH{=}CH_2$$

Compound (5):

$$CH_2{=}CHSO_2CH_2\underset{\underset{OH}{|}}{C}H\underset{\underset{OH}{|}}{C}H\underset{\underset{OH}{|}}{C}HCH_2SO_2CH{=}CH_2$$

Compound (6):

$$CH_2{=}CHSO_2{-}CH_2{-}\underset{\underset{OH}{|}}{C}H{-}CH_2{-}O{-}CH_2{-}\underset{\underset{OH}{|}}{C}H{-}CH_2{-}SO_2{-}CH{=}CH_2$$

Compound (7):

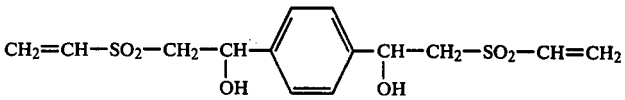

-continued

Compound (8):

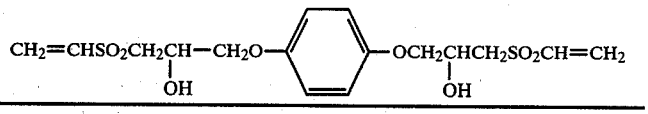

Then, the method of preparing above-described compound (1) is described in the following Synthesis Example.

SYNTHESIS EXAMPLE

In a solution of 10 g of mercaptoethanol in 60 ml of ethanol is dissolved 2.7 g of sodium hydroxide and while stirring the mixture, 5.9 g of epichlorohydrin is added dropwise to the mixture at 60° C. After further stirring the mixture for 3 hours at 75° C., the reaction mixture is cooled and crystals formed are filtered away. The filtrate is concentrated and after adding thereto 50 ml of water and 0.2 g of sodium tungstate, the mixture is adjusted to a pH 6 with acetic acid. Then, 24.5 g of 34% hydrogen peroxide solution is added dropwise to the mixture with stirring at 70° C. and the mixture is further stirred for 3 hours at 75° C. The reaction mixture is concentrated and recrystallized from methanol to give 16.2 g of 1,3-bis(hydroxyethylsulfonyl)-2-propanol. After adding to 10 g of the product a catalytic amount of pyridine and further 15 ml of thionyl chloride, the mixture is stirred for 2 hours at 50° C. The reaction mixture is concentrated at reduced pressure and recrystallized from water to give 9.2 g of 1,3-bis(-chloroethylsulfonyl)-2-propanol. In 50 ml of acetone is dissolved 5.0 g of the product and then 3.3 g of triethylamine is added dropwise to the solution with stirring at room temperature. Crystals formed are filtered away and the filtrate is concentrated under reduced pressure and recrystallized from ethanol to give 3.1 g of the desired product, 1,3-bis(vinylsulfonyl)-2-propanol, Compound (1).

By following the same procedure as above using 1,4-dichloro-2,3-butanediol in place of epichlorohydrin, 1,4-bis(vinylsulfonyl)-2,3-butanediol, Compound (2) is obtained.

The basic elements of a subbing composition are a solvent (e.g., water) and a hydrophilic component (e.g, a hydrophilic colloid such as gelatin) as a binder for the subbing layer. There is no particular restriction about the addition amount of the compound of general formula (I) in the subbing composition used in this invention but it is usually present in an amount of 0.025 to 0.4 g, preferably 0.05 to 0.15 g per 100 ml of the subbing composition. Based on the hydrophilic colloid the compound is present in an amount of from 0.1 to 50% by weight, preferably from 1 to 20% by weight.

If the amount of the compound is smaller than 0.025 g per 100 ml of the subbing composition, the adhesive property in the dry state becomes lower while if the amount is larger than 0.4 g, the adhesive property in the wet state becomes lower.

It is preferred to use water as the solvent for the liquid subbing composition in this invention but an organic solvent such as methanol, acetone, etc., may be used and also the organic solvent may be used with water.

The subbing composition used in this invention may further contain a swelling agent for the polyester, a surface active agent, a hydrophilic organic colloid, a hardening agent, a matting agent, etc. These material and their use in subbing methods are familiar to those of ordinary skill in the art.

As the swelling agent for the polyester, for example, phenol, resorcinol, etc., described in U.S. Pat. Nos. 3,245,937; 3,143,421; 3,501,301 and 3,271,178 can be preferably used. The addition amount of the swelling agent for polyester is 1 to 20 g, preferably 3 to 12 g per 100 ml of the subbing composition. Based on the hydrophilic colloid the amount of the swelling agent is from 100 to 5,000% by weight, preferably from 500 to 3,000% by weight.

The subbing composition used in this invention may contain known surface active agents for various purposes, such as a wetting agent, an antistatic agent, etc. Examples of such surface active agent are nonionic surface active agents such as saponin, alkylene oxide derivatives, etc.; anionic surface active agents having acid groups, such as alkyl carboxylates, alkyl sulfonates, alkylbenzenesulfonates, etc.; amphoteric surface active agents such as amino acids, etc.; and cationic surface active agents such as alkylamine salts, aliphatic quaternary ammonium salts, aromatic quaternary ammonium salts, etc.

The hydrophilic colloid used in the subbing composition of this invention is most preferably gelatin but other natural hydrophilic polymers and synthetic hydrophilic polymers such as polyvinylpyrrolidone, polyhydroxy alkyl acrylate, polyacrylamide, etc., may be used.

In this invention, the subbing layer is formed on a polyester film and the polyester preferably used in this invention is the polyester comprising an aromatic dibasic acid and a glycol as its main structural components. Typical examples of the dibasic acid are terephthalic acid, isophthalic acid, p-$\beta$-oxyethyoxybenzoic acid, diphenylsulfondicarboxylic acid, diphenoxyethanedicarboxylic acid, adipic acid, sebacic acid, azelaic acid, 5-sodiumsulfoisophthalic acid, diphenylenedicarboxylic acid, 2,6-naphthalenedicarboxylic acid, etc. Typical examples of the glycol are ethylene glycol, propylene glycol, butanediol, neopentylene glycol, 1,4-cyclohexanediol, 1,4-cyclohexanedimethanol, 1,4-bisoxyethoxybenzene, bisphenol A, diethylene glycol, polyethylene glycol, etc.

Of these polyesters having the above-described components, polyethylene terephthalate is most favorable because it is readily obtainable.

The polyester film used at the practice of this invention may be one at least the surface of which is polyester, that is, the support may be made of another material than polyester and carry thereon a polyester surface layer. The surface of the polyester film used in this invention may have optionally been subjected to various surface treatments. Examples of such surface treatment are the treatment with an oxidizing agent solution as described in U.S. Pat. No 2,943,937, etc.; ultraviolet irradiation treatment as described in U.S. Pat. No. 3,475,193; electric discharge treatment such as the corona discharge treatment as described in U.S. Pat. No. 3,615,557, etc; active gas treatment as described in British Pat. No. 1,215,234, etc.; flame treatment as described in U.S. Pat. No. 3,590,107, etc.; as well as coating the surface of polyester film with a polymer layer composed of the vinylidene chloride copolymer as described in Japanese patent application (OPI) No. 135,526/'76; or butadiene copolymer as described in Japanese patent publication No. 3564/'73; or a cellulose ester such as nitrocellulose.

In this invention, the subbing layer containing the compound of this invention is formed on a polyester film and then a photographic hydrophilic colloid layer is formed on the subbing layer and in this case, the photographic hydrophilic colloid layer may be formed directly on the subbing layer or may be formed after forming thereon a hardened gelatin layer and/or an antistatic agent layer.

The photographic hydrophilic colloid layer in this invention may be a photographic layer containing a hydrophilic organic colloid as the binder such as a silver halide photographic emulsion layer, a surface protective layer, a backing layer, an interlayer, a filter layer, etc. As the hydrophilic organic colloid layer, gelatin or a gelatin derivatives are most commonly used but other natural hydrophilic polymers and synthetic hydrophilic polymers may also be used.

Various additives for the hydrophilic organic colloid layers in this invention, such as, for example, silver halide, chemical sensitizers, antifoggant, hardening agent, plasticizers, coating aid, matting agent, color coupler, etc., are described, for example, in Research Disclosure; Vol. 92, 107–110 (1971, December).

The method of this invention will be further explained by the following examples, however, the invention is not limited to the disclosed examples.

In the examples, the adhesive property of a photosensitive silver halide emulsion layer to a film support was measured by the following conventional tests and evaluated as shown below.

ADHESIVE PROPERTY TEST IN THE DRY STATE

Checker like cuts (the interval between the lines was about 4 mm) were formed on the surface of a silver halide emulsion layer formed on an untreated film and also on the surface of a silver halide emulsion layer formed on the dry film treated according to the method of this invention using a razor blade. An adhesive tape [e.g., a polyester adhesive tape (Nitto Tape No. 31 made by Nitto Denki Kogyo K.K.)] was stuck on the surface of the silver halide emulsion layer and then stripped off quickly. In this test, when the unstripped portion is larger than 90% of the total area the adhesive strength is designated as grade A, when the unstripped portion is 60% to 90% adhesive strength is designated as grade B and when the unstripped portion is less than 60% adhesive strength is designated as grade C.

ADHESIVE TEST IN WET STATE

One scratch line was formed on the surface of a silver halide emulsion layer formed on each film using a stylus in a processing solution at each of development, fixing, and washing and the surface of the emulsion layer was rubbed by finger head in the direction perpendicular to the scratch line. When the emulsion layer did not strip over the scratch line the adhesive strength is designated as grade A, when the maximum width of the stripped layer is within 5 mm the adhesive strength is designated as grade B, and when the stripped width of the layer is larger than 5 mm the adhesive strength is designated as grade C.

EXAMPLE 1

A polyethylene terephthalate film support was passed at a speed of 10 meters/min. through a treatment box of 120 cm length, 60 cm width, and 50 cm depth while irradiating the film therein with three tubular quartz mercury lamps each of 1 kilowatt, 50 cm width, and 30 cm arc length at 120° C. with an interval of 13 cm. The film support thus treated was wound once and then was coated with one of the gelatin coating compositions (1), (2) and (3) shown in Table 1 by an ordinary dip coating method and dried for 3 minutes at 120° C. A gelatin silver halide emulsion layer was coated on the subbing layer thus formed followed by drying to give a photographic film sample. Thus, various samples were prepared. By testing the adhesive properties of these samples, it has been confirmed that the samples having the subbing layer containing the compound of this invention are superior in their adhesive properties in the dry state and the wet state to the sample in which the subbing layer did not contain the compound of this invention. The results are shown in Table 2.

Table 1

| | Coating composition (1) | Coating composition (2) | Coating composition (3) |
|---|---|---|---|
| Gelatin | 1 g | 1 g | 1 g |
| Water | 100 g | 100 g | 100 g |
| Acetic acid | 0.3 ml | 0.3 ml | 0.3 ml |
| Resorcinol | 10 g | 10 g | 10 g |
| Compound (1) | 0.1 g | 0.05 g | — |

Table 2

| Coating composition | Remarks | Dry State Adhesive Property | Wet State Adhesive Property |
|---|---|---|---|
| (1) | invention | A | A |
| (2) | invention | B | A |
| (3) | comparison | C | C |

Also, the photographic properties of the photographic films containing the compound of this invention prepared by the manner as mentioned above were as good as those of the comparison photographic film containing no such compound.

EXAMPLE 2

A polyethylene terephthalate film having a thickness of 100 microns was coated with an aqueous dispersion of a vinylidene chloride copolymer having the following composition and dried for 10 mintes at 120° C.

| | |
|---|---|
| Vinylidene chloride copolymer latex* | 10 g |
| Resorcinol | 3 g |
| Water | 87 g |

*The copolymer of vinylidene chloride, ethyl acrylate, and acrylic acid of 80 : 18 : 2 by mole ratio and the concentration of the latex was 10% by weight.

Then, the coating composition shown in Table 3 was coated on the copolymer layer and dried for 5 minutes at 120° C. to give a subbing layer.

Table 3

| | Coating composition (4) | Coating composition (5) |
|---|---|---|
| Gelatin | 1.5 g | 1.5 g |
| Saponin | 0.005 g | 0.005 g |
| Compound (1) | 0.1 g | — |
| Water | 98.4 g | 98.5 g |

By coating further a silver halide emulsion on the subbing layer, a sample photographic film was prepared. The adhesive properties of the sample are shown in Table 4. As shown in the table, the sample containing the compound of this invention was superior in adhesive property in dry state as well as wet state.

Table 4

| Coating composition | Remarks | Dry State Adhesive Property | Wet State Adhesive Property |
|---|---|---|---|
| (4) | | A | A |
| (5) | | A | C |
| (3) | comparison | C | C |

While the invention has been described in detail and with reference to specific embodiments thereof, it will be apparent to one skilled in the art that various changes and modifications can be made therein without departing from the spirit and scope thereof.

What is claimed is:

1. A method for subbing a polyester film which comprises forming on the polyester film, prior to forming thereon a hydrophilic organic colloid layer, a layer containing at least one of the compounds represented by general formula

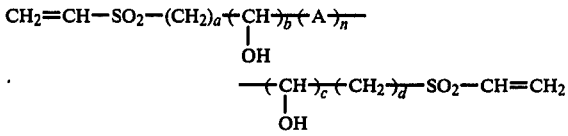

wherein a and d represent 1 or 2; b and c represent 0, 1 or 2 but b and c must not be 0 at the same time; A represents a divalent group; and n represents 0 or 1.

2. The method of claim 1 wherein the hydrophilic organic colloid layer is a photographic silver halide emulsion layer.

3. The method of claim 1 wherein the polyester film is a polyethylene terephthalate film.

4. The method of claim 1 wherein the divalent group shown by A of the general formula is an alkylene group having 1 to 8 atoms or an arylene group having 6 to 12 carbon atoms, which may contain a hetero-atom.

5. The method of claim 1 wherein a, b, c, d, A and n in the general formula are selected such that the following relation is satisfied $$\frac{\text{molecular weight}}{\text{number of hydroxyl groups in one molecule}} \leqq 260.$$

6. The method of claim 1 wherein the solvent for the subbing layer containing the compound is water or an organic solvent.

7. The method of claim 6 wherein said organic solvent is methanol or acetone.

* * * * *